United States Patent [19]

Daverio et al.

[11] 4,312,094

[45] Jan. 26, 1982

[54] APPARATUS FOR RAPIDLY COOLING ELONGATED METALLIC PRODUCTS DURING THEIR MOVEMENT IN LONGITUDINAL DIRECTION BY A LIQUID COOLING JET AND FOR REMOVING THE LATTER FROM THE SURFACE OF THE PRODUCT AFTER THE COOLING

[76] Inventors: Jean-Claude Daverio, 1, rue des Pataljons Ban Saint-Martin, 5700 Metz; Francis Bertolotti, 6 bis avenue des Ecoles, 14460 Colombelles; Georges Weber, 10, route de Lorry, 5700 Metz, all of France

[21] Appl. No.: 101,054

[22] Filed: Dec. 6, 1979

[30] Foreign Application Priority Data

Dec. 26, 1978 [FR] France ..... 78 36617

[51] Int. Cl.[3] ..... B21B 45/02

[52] U.S. Cl. ..... 15/302; 15/306 A

[58] Field of Search ..... 15/306 A, 306 R, 302, 15/308

[56] References Cited

U.S. PATENT DOCUMENTS

| | | | |
|---|---|---|---|
| 1,575,526 | 3/1926 | Bocher | 15/306 A X |
| 1,886,581 | 11/1932 | Pitts | 15/306 A X |
| 2,234,153 | 3/1941 | Herbert | 15/306 A X |
| 2,255,859 | 9/1941 | Quigley | 15/306 A |
| 2,289,753 | 7/1942 | Capstaff | 15/306 A |
| 3,044,098 | 7/1962 | Stalson | 15/306 A X |

*Primary Examiner*—Chris K. Moore

*Attorney, Agent, or Firm*—Michael J. Striker

[57] ABSTRACT

Apparatus for rapidly cooling elongated products during the movement thereof in longitudinal direction mainly comprises an elongated tube, a cooling water feed head communicating with one open end of the tube and a separator communicating with the other open end of the tube. The cooling water feed head and the separator are respectively provided in walls facing the opposite ends of the tube with openings aligned with the tube axis through which the product passes surrounded by a cooling water jet during its passage through the tube into the separator. A first device is located in the separator for reducing the diameter of the cooling water jet, and a second device, preferably in form of a secondary water jet, extends transverse to the axis of the tube spaced from the first device, is provided in the separator for shearing the water jet of reduced diameter surrounding the product.

11 Claims, 6 Drawing Figures

Figure 1:
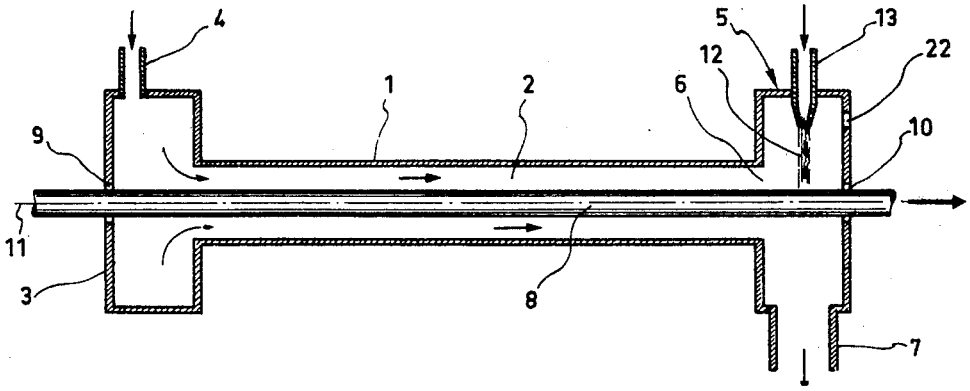

APPARATUS FOR RAPIDLY COOLING ELONGATED METALLIC PRODUCTS DURING THEIR MOVEMENT IN LONGITUDINAL DIRECTION BY A LIQUID COOLING JET AND FOR REMOVING THE LATTER FROM THE SURFACE OF THE PRODUCT AFTER THE COOLING

This invention concerns an apparatus for rapidly cooling elongated products during the movement thereof in longitudinal direction by a liquid cooling jet surrounding the product and for removing the cooling jet as the product leaves the apparatus.

The need for such a device is encountered, for example, at the outlet of a cooling apparatus consisting essentially of a pipe crossed by a cooling liquid (usually water) and along the axis of which a long product to be cooled also moves. The pipe contains, at one of its ends, a cooling liquid feed head and, at the other end, a separator, the function of which is to separate, at the outlet of the pipe, the streaming product from the liquid jet enveloping it.

Without being limited in application to certain particular industrial area, such apparatuses are found, notably, in steelmaking, in continuous casting, for example, or especially in special heat treatments for rapidly and forcibly cooling long products at end of rolling. In view of these cooling requirements, the need was quickly perceived for providing, at the outlet of the pipe, an element which, while assuring free passage to the moving product in a straight line, makes possible the recovery and discharge of the cooling liquid by interrupting, for reasons of space, preferably, over the shortest possible distance, the liquid envelope, which would otherwise come out of the pipe in a powerful jet easily capable of reaching some ten meters and which, in addition would make control of the cooling process more difficult.

In order to do so, a separator consisting of a simple recovery box or tank has previously been proposed. This box, open at the bottom for discharge of the recovered liquid, contains a side opening through which enters the liquid jet coaxial to the product and, in the alignment of that opening, a side hole dimensioned so as to make possible to best advantage the free passage of the moving product, while blocking the liquid jet enveloping it. This solution, though certainly advantageous in its simplicity, however presents problems, notably, with regard to the tightness of the box at the product passage hole. In fact, that hole cannot be made as close as one wants to the diameter of the product to be cooled, so that the ring-shaped slit, necessarily present between the two, constitutes for the jet a preferential escape route, thus very appreciably detracting from the jet blocking function it was desired to assign to such a box.

It has also been proposed, for example, in French Pat. No. 2,226,221, U.S. Pat. No. 1,874,959 and German Pat. No. 2,556,383, in order to improve the effectiveness of such separators and, notably, minimize the quantities of water carried outside, that a shearing effect be applied to the jet surrounding the product by means of a secondary jet forming a certain angle with the principal jet. However, that shearing effect is not always sufficient, particularly in the case of principal jets exhibiting a considerable momentum, to prevent any discharge of water from the separator.

It is an object of the present invention to provide an apparatus for rapidly cooling elongated metallic products during the movement thereof in longitudinal direction in which the separator at one end of the apparatus is constructed in such a manner to efficiently interrupt the liquid jet in the separator while permitting free passage of the moving product from the apparatus.

With these and other objects in view, which will become apparent as the description proceeds, the apparatus of the present invention for rapidly cooling elongated metallic products during their movement in longitudinal direction mainly comprises an elongated tube having opposite open ends, a box-shaped cooling water feed head communicating with one of the opposite ends of the tube, a box-shaped separator communicating with the other of the opposite ends in which the cooling water feed head and the separator are provided in walls opposite the opposite ends of the tube with openings aligned with the axis of the tube through which the products to be cooled are adapted to pass to be surrounded by a jet of cooling water during its passage through the tube into the separator. The separator is provided at a lower portion thereof with a cooling water outlet and means are provided in the separator for reducing the thickness of the cooling water jet surrounding the product, and additional means are also provided in the separator spaced in the direction of the axis of the tube from the reducing means for shearing the cooling water jet.

The means for shearing the cooling water jet are preferably constituted by a secondary jet, preferably a liquid jet, which is directed substantially normal to the axis of the tube.

The qualifier "secondary" is understood to distinguish the jet shearing the jet enveloping the product, which can be qualified as "principal".

Furthermore, the expression "at least one secondary jet" is understood to allow for the possibility of several successive jets arranged one after the other along the axis of the openings defined above.

In addition, it is useful to specify, for an understanding of the invention, that it is not a question of creating locally a sort of ring-shaped screen surrounding the product, which might be formed by a multiple number of radial secondary jets evenly distributed around the axis of the openings and converging at the same point on the latter. It is rather a question of producing a shearing of the principal jet to be blocked, that is, a sudden deflection, which will exclude the use of several opposing jets and require only one jet or at most several converging on the same spot, but not opposing each other.

"Weakening (or softening) of the principal jet" is understood as a reduction of its momentum, which can take place in several ways and, notably, through a reduction of the thickness of the jet. The latter can be carried out, for example, in a suitable pressure loss device, that is, throttling the jet without thereby interfering with free passage of the streaming product enveloped by the latter or appreciably disturbing the hydrodynamic characteristics of the flow above the separator.

For this purpose, it is possible to use, for example, a nozzle, nose, etc., or a simple truncated cone-shaped collar, converging in the direction of propagation of the jet and along the axis of which the streaming product passes freely, but the narrowest section of which presents, of course, a diameter less than that of the jet.

This reduction of thickness can further be produced by a deflection of the peripheral ring-shaped layer of the principal jet without occasioning on the whole an appreciable pressure loss. The diminution of momentum then takes place solely with a diminution of flow of the principal jet. Such peripheral deflection can be obtained by means of a deflector, consisting, for example, like before, of a truncated cone-shaped collar placed on the passage of the streaming product, but the convergence of which is oriented this time in a direction opposite that of propagation of the principal jet. Of course, the small open base of the deflector must necessarily present a section less than that of the principal jet, the difference between the two determining the thickness of the deflected ring-shaped layer.

It is pointed out, however, for reasons that will be clearly apparent in the course of the specification that this variant is far less suitable than the first when the streaming product and the liquid envelope run in the same direction.

As will have been already understood, this invention consists in its main features:

of interrupting the principal jet by shearing by means of a secondary jet which is perpendicular to it;

preferably and prior to the shearing action, of placing on the course of the principal jet one or more successive devices having the function of softening or, if preferred, of weakening the principal jet;

finally, of containing everything in a box used for collection and discharge of the liquid thus recovered.

In addition, drying of the product at the outlet of the box is completed by blowing means directing at least one gas jet, e.g., air, on the product.

Figure 2:
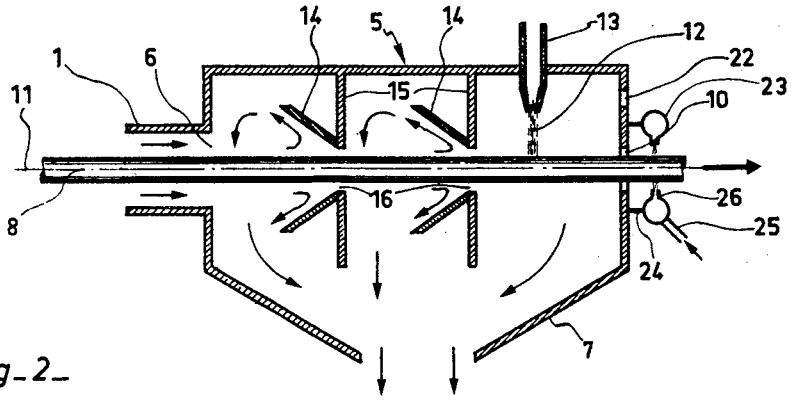
Figure 3:
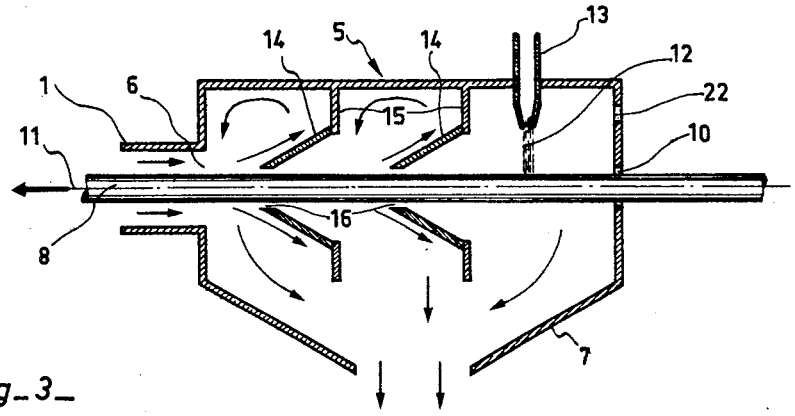
Figure 4:
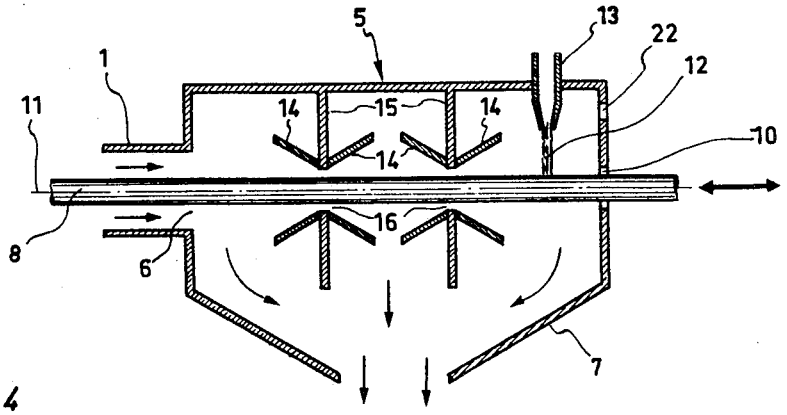
Figure 5:
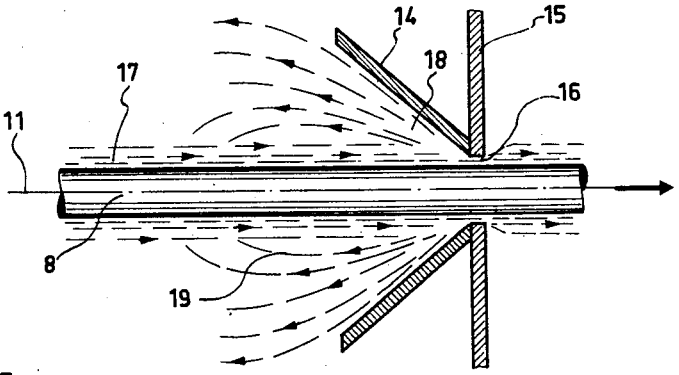
Figure 6:
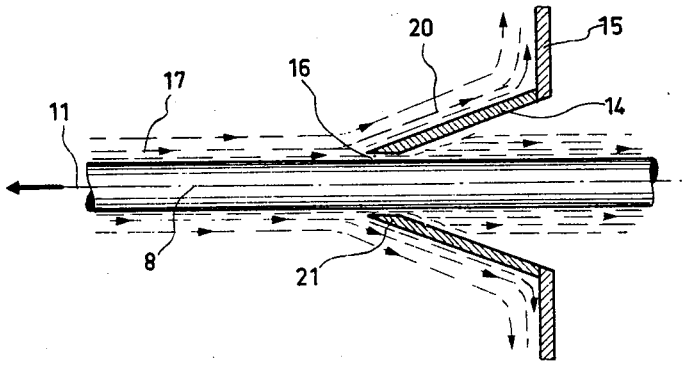

The invention will be well understood and other aspects and advantages will more clearly emerge in light of the specification which follows, given with reference to the attached plates of drawings, on which:

FIG. 1 is a schematic view in axial section of a device for cooling streaming metal bars, equipped with a terminal separator according to the invention;

FIGS. 2, 3 and 4 each represent, in axial section, a practical variant of the separator according to the invention;

FIGS. 5 and 6 schematically illustrate the mode of action of the means, according to the invention, for weakening the principal jet.

On all of the figures, the same elements are designated by identical references.

As FIG. 1 shows, the cooling device comprises:

an elongated pipe 1 crossed, in the direction indicated by the arrows, by a flow 2 of cooling liquid, which it will be assumed is water;

a feed head 3 set up at one end of pipe 1, receiving water through an inlet tube 4 and injecting it into the pipe, and at the other end, a separator 5 receiving the water jet at the outlet of the pipe through a side opening 6 and designed to block that jet, to collect the water thus recovered and to discharge it at the bottom through an outlet 7.

The bar 8 to be cooled crosses the device from one side to another and in a straight course, passing along axis 11 of pipe 1. Openings 9 and 10 machined respectively in feed head 3 and in separator 5 make possible the free passage of bar 8. It is to be noted that hole 10 of the separator is made in the alignment of opening 6, in order to make sure that bar 8 crosses in a straight line. Opening 6 and hole 9 are then coaxial and their axes coincide with that of the pipe 1. It is also to be noted that cooling of the bar 8 takes place essentially on its passage in pipe 1 by direct contact with the water jet 2 enveloping it and circulating at high speed.

It is to be pointed out in this connection that bar 8 and cooling jet 2 can run either "with the flow," that is, in the same direction, or "against the flow," that is, in opposite directions. Also in the figure the arrowed indication of movement of bar 8 only emphasizes the fact that the latter is not immobile, but moving, without it thereby being possible to judge beforehand the actual direction of movement.

According to the invention, separator 5 consists of a box, inside which a secondary jet interrupts the principal jet by a shearing effect. For that purpose, the secondary jet 12 comes out of a nozzle 13 perpendicular to axis 11, that is, to the principal jet (not represented) surrounding bar 8.

That secondary jet 12 can be gas or, preferably, liquid, e.g., water. In that case, nozzle 13 can advantageously consist, at the outlet end, of a pipe shunt connected to the cooling water supply serving feed head 3.

The position of nozzle 13 around axis 11 little matters. The figure shows it set up across the top of box 5, so that shearing jet 13 is oriented vertically, thus benefiting to the maximum from the effect of gravity, but it could just as well have been set up across the side partitions situated in the planes parallel to the plane of the figure.

When the principal jet presents a considerable momentum, as in the case of heat treatment of long products at the end of rolling, the power of the secondary jet, necessary for obtaining an effective shearing effect, could be such that it is to be feared that there might be some difficulties in guiding the product, due to deflection of the head at the time of its insertion in the separator, and then bending of the product (notably, for products of small diameter) at the point of impact of the jet. It is therefore preferable to be able to operate with a jet of moderate impulse, which implies, everything otherwise being equal, acting on a preweakened principal jet. The importance of the means for softening the principal jet, previously mentioned, and placed upstream the shearing jet in the direction of propagation of the principal jet becomes apparent here.

Off hand, it is correct to think that, the greater the number of successive softening means, the better the end result obtained.

In fact, as a general rule, a succession of two softening means is sufficient to soften the jet so that, after shearing, almost all of the water will be recovered in the separator.

The following figures illustrate several practical variants of a separator according to the invention and including two devices for prior weakening of the principal jet.

On FIGS. 2, 3 and 4 the principal jet has not been represented in order not to overload them. As can be seen, the means for prior weakening of the principal jet can be simple collars 14 that are truncated cone-shaped and surrounding product 8. These collars can be maintained by any suitable supporting structure, such as connecting flanges, etc. In the examples described, the supporting structures consist of partitions 15, arranged perpendicular to the axis of openings 6 and 10. These partitions are attached on the upper face of box 5 and left free at their lower end. They present a hole 16 for passage of product 8 and collars 14 are joined on the edges of these holes.

A box 5 is thus formed, partitioned into several successive compartments, aligned along the moving product and each recovering a fraction of the water constituting the principal jet coming out of pipe 1 and the discharge of which is assured through outlet funnel 7.

In principle, the relative positions between collars 14 and nozzle 13 can be reversed. However, for a given number of successive collars 14, the greater the number of collars inserted between the outlet of the pipe and the shearing jet, the better the results (absence of projection of water through hole 10).

Thus, in the case of a box with three compartments (therefore, with two successive collars 14), as represented on the figures, the nozzle 13 located in the most distant compartment of the pipe gives better results than if it were placed in the middle compartment and, in that case, even better than if it were located in the first compartment into which pipe 1 emerges.

Furthermore, a number of successive collars equal or close to two is desirable in the majority of cases. Under these conditions, the principal jet is entirely interrupted in box 5. Below that number, the quantity of residual water gushing through hole 10 is no longer negligible. Beyond that, the means often become superfluous and detract from the cooling device owing to the resulting unnecessary extra length.

Some possible arrangements of these means of weakening the principal jet as well as their mode of action on the latter are now going to be described.

A first arrangement consists, as shown on FIG. 2, of placing the truncated cone-shaped collars 14 so as to make them converge in the direction of propagation of the jet. They can then be either joined by the small base on the face of partitions 15 turned toward the pipe (case of the figure), or joined by the wide base on the opposite face of partitions 15. Whatever the solution adopted, these collars, the small base of which presents a diameter less than than of the jet, serve as pressure loss devices by throttling the principal jet crossing them axially. This practical variant appears well suited to a streaming product-cooling water circulation "with the flow," for the collars then constitute, with respect to the streaming product, an introduction cone which facilitates guidance of the head of the product on its passage through the box.

In addition, such an arrangement presents another advantage: as the enlarged view of FIG. 5 shows, collar 14 fulfills, with respect to the jet (reference 17), a supplementary reflection function by causing a part 18 of the water of the principal jet to turn back, a considerable fraction 19 of that turned back part then coming down on the jet upstream the collar. This "fallen" portion 19 disturbs the jet before throttling and thus favorably contributes to its weakening. It can easily be understood that collar 14 fulfills its function as a reflector only if its large base, through which jet 17 enters, presents a diameter greater than that of the jet.

A second possible arrangement is illustrated on FIG. 3. This practical variant is characterized by a layout of truncated cone-shaped collars 14 such as to render them divergent in the direction of propagation of the principal jet. This time the reduction in thickness of the latter is no longer made by throttling and reflection, as in the previous variant, but, as clearly shown by the enlarged view of FIG. 6, by deflection of a peripheral ring-shaped layer 20, this deflection function being, of course, fulfilled by collar 14, which presents a small base of diameter less than that of the jet and the beveled end 21 of which acts in a way like a ring-shaped blade which "pares" the jet on its periphery. The peripheral ring-shaped layer 20 thus cut away is then deflected by passage over the outer face of the collar. For the reasons previously mentioned, it is understood that such practical variant is this time better suited to a product-water circulation "against the flow."

Another possible arrangement is represented on FIG. 4. This practical variant, which can be qualified as "universal," since it can be accommodated just as well to circulation "with the flow" as "against the flow," is characterized by the fact that the means of weakening of the principal jet are made by means of two coaxial collars 14 assembled by their small bases.

It is to be noted that, regardless of the variant used, an appreciably improved and more regular operation of separator 5 is encountered, when an opening is made in the latter, close to the end of nozzle 13. It then seems beneficial to create, in proximity to the shearing jet, an air intake, represented by 22 on the figures.

It is to be understood that, in spite of an effective interruption of the principal jet in the box, a slight leakage generally escapes through passage opening 10. This leakage is moreover unavoidable in the case of a circulation "with the flow," for the streaming product then carries with it residual moisture in the form of a fine liquid film or, at best, of droplets which cling to the surface. Taking into account the surface temperature of the product after cooling (in the order of 200° C.), this residual moisture is eliminated naturally at the end of a few seconds. However, owing to the high speed of moving of the product, moisture accompanies the latter over a rather appreciable distance and it may be desired to eliminate it as soon as it comes out of the box.

This is accomplished, according to a variant of the invention, by equipping the box on the outside with means of supplementary drying by gas blowing.

There can be one or more blowing jets, e.g., a multiple number of radial gas jets converging at the same point on the product at the outlet of the box and forming a gas disk around the product. This gas disk eliminates the residual moisture by mechanical effect due to the blowing itself, combined possibly with a thermal effect if provision is made for a preheating of the gas. The latter can be of any kind. For evident reasons of convenience, air will be preferably used. A practical example of these supplementary drying means is illustrated on FIG. 2. As can be seen, it is a question of a simple circular pipe 23 surrounding the product 8 to be dried and placed outside box 5 in immediate proximity to passage hole 10. Pipe 23 is connected to the box by means of connecting flanges 23. This pipe is fed by tube 25 with compressed air from a source not represented and blowing on product 8 is carried out by means of a multiple number of radial outlet nozzles 26 directed perpendicular to axis 11, so as to create around the product the air disk previously mentioned.

Of course, this invention should not be limited to the examples described, with regard to making the means of shearing and weakening of the jet or of supplementary drying of the product, as well as to the range of application of the separator.

Thus, the means of weakening the jet can be made differently insofar as they consist of a body presenting an axial slot allowing for free passage of the streaming product. In the case of the variant with reflector (FIGS. 2 and 5), it matters only that this slot present a convergent internal profile in the direction of propagation of the jet, while, in the case of the variant with deflector (FIGS. 3 and 6), the condition to be observed resides in the divergent shape, in the direction of propagation of the jet, of the external profile this time of the means employed.

Finally, in the case of the so-called "universal" variant (FIG. 4), it is easily understandable that the only necessary characteristic of these weakening means consists of giving them an internal profile of convergent-divergent shape.

The means of supplementary drying of the product at the outlet of the box can likewise employ known principles to eliminate residual moisture other than those described, e.g., through absorption, suction, etc. Furthermore, other variants can be applied to make the means of drying by gas blowing. It is not indispensable, in fact, for blowing to take place perpendicular to the product. The tilt of nozzles 26 (FIG. 2) can thus be modified at will, e.g, so as to direct the gas jets to passage hole 10 of the box. Blowing thus produces a gas barrier which stops at the source the leakage flow from the principal jet. On the other hand, nozzles 26 can be pointed in an opposite direction, which has the effect of forming around the product to be dried a gas mantle favoring, by convection, the elimination of residual moisture. Of course, ring-shaped pipe 23 can be equipped with several series of nozzles of different tilts, in order to use the above-mentioned drying mechanisms simultaneously.

Furthermore, the separator, according to the invention, is applicable not only to the cooling of long products at end of rolling, but to any other industrial field, in which it is advantageous to eliminate rapidly a liquid film from the surface of a moving product. Such is the case, notably, with continuous casting of metals, e.g., steel, in which cooling of the bar cast in the so-called "secondary cooling" stage of the installation can be carried out with a water jacket channeled in a sleeve surrounding the bar and moving in contact with the surface of the latter.

We claim:

1. Apparatus for rapidly cooling elongated metallic products during their movement in longitudinal direction, comprising an elongated tube having an axis and opposite open ends; a box-shaped cooling water feed head communicating with one of said opposite ends of said tube; a box-shaped separator communicating with the other of said opposite ends, said cooling water feed head and said separator being provided in walls opposite said opposite open ends of said tube with openings aligned with the axis of the tube through which the product to be cooled is adapted to pass to be surrounded by a jet of cooling water during its passage through the tube into said separator; a cooling water outlet at a lower portion of said separator; means in said separator for reducing the thickness of said cooling water jet surrounding the product; and additional means in said separator spaced in direction of said axis from said reducing means for shearing said cooling water jet.

2. Apparatus as defined in claim 1, wherein said thickness reducing means comprises a hollow frustoconical member coaxial with the cooling water jet and having at one end an inner diameter greater than that of said jet and at the other end an inner diameter smaller than that of said jet.

3. Apparatus as defined in claim 2, wherein said larger diameter end of said frustoconical member faces said other end of said tube, so that the jet enters said frustoconical member through said large diameter end thereof.

4. Apparatus as defined in claim 2, wherein said smaller diameter end of said frustoconical member faces said other end of said tube, so that the jet enters said frustoconical member through said small diameter end thereof.

5. Apparatus as defined in claim 1, wherein said jet shearing means comprises at least one secondary jet extending transverse to the axis of said tube.

6. Apparatus as defined in claim 1, wherein said jet shearing means comprises at least one secondary jet extending substantially normal to the axis of said tube.

7. Apparatus as defined in claim 1, and including supplementary drying means closely adjacent said opening said wall of said separator at the outside of the latter.

8. Apparatus as defined in claim 7, wherein said supplementary drying means comprises means for blowing at least one jet of gas onto the product.

9. Apparatus as defined in claim 8, wherein said blowing means comprises an annular pipe surrounding said opening in said wall of said separator radially outwardly spaced therefrom and coaxially therewith, means for feeding a gas under pressure into said pipe and a plurality of outlet nozzles communicating with said pipe and extending radially inwardly from the latter.

10. Apparatus as defined in claim 1, and including an air intake opening in said wall of said separator.

11. Apparatus as defined in claim 1, wherein said additional means is located between said reducing means and said wall of said separator.

* * * * *